US006368167B1

(12) United States Patent
Ma et al.

(10) Patent No.: US 6,368,167 B1
(45) Date of Patent: Apr. 9, 2002

(54) METHOD OF MAKING AN ELECTRICAL CONNECTOR

(75) Inventors: Xuedong Ma; Guang Xing Shi, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/746,085

(22) Filed: Dec. 22, 2000

(51) Int. Cl.[7] ..... H01R 13/03

(52) U.S. Cl. ..... 439/886; 439/607; 29/885; 29/876

(58) Field of Search ..... 29/885, 876; 439/676, 439/607–610, 886, 83, 876, 569–572

(56) References Cited

U.S. PATENT DOCUMENTS 5,916,695 A * 6/1999 Fister et al. ..... 439/886
5,957,736 A * 9/1999 Moriuchi et al. ..... 439/886
6,007,390 A * 12/1999 Cheng et al. ..... 439/886
6,086,429 A * 7/2000 Wu ..... 439/607
6,095,865 A * 8/2000 Wu ..... 439/607
6,125,535 A * 10/2000 Chiou et al. ..... 29/883
6,155,878 A * 10/2000 Chen ..... 439/607

* cited by examiner

*Primary Examiner*—Gary Paumen
(74) *Attorney, Agent, or Firm*—Wei Te Chung

(57) ABSTRACT

A method of making the electrical connector (100) includes the steps of: a. forming a housing (2) which defines a chamber (20) therethrough in a rear-to-front direction; b. making a contact module (3); c. stamping and forming a shield (1) having a body portion (12) and a pair of integral solder tails (13) on the body portion; d. applying a plating of nickel material on both the body portion and the integral solder tails of the shield; e. applying a plating of tin-lead alloy material on only the integral solder tails by selective plating; f. assembling the contact module, the housing and the shield together.

1 Claim, 9 Drawing Sheets

METHOD OF MAKING AN ELECTRICAL CONNECTOR

BACKGROUND OF THE INVENTION

1. Field of the Invention

The present invention relates to a method of making an electrical connector, and particularly to a method including a unique step of plating a conductive shield of the connector.

2. Description of the Related Art

Electrical connectors related to the present invention each typically include a contact module having a plurality of contacts therein, an insulative housing engageably enclosing the contact module therein and a conductive shield shrouding the housing. The shield typically has a body portion and integral solder tails downwardly extending from the body portion for electrically and mechanically connecting to a printed circuit board (PCB).In manufacture of the shield, after stamping and forming, the body portion and the solder tails of the shield are both plated with either a nickel material only for good anti-corrosion performance, or a nickel plating followed by a tin-lead alloy plating to improve solderability of the solder tails to solder pads in the PCB.

However, various problems are encountered in usage of the connectors. If the shield is only plated with a nickel material, connections between the solder tails and the solder pads of the PCB are not secure due to poor soldering characteristics of the nickel material to tin-lead alloy. If the shield is plated with a tin-lead alloy material after the nickel plating, the body portion is not resistant enough to corrosion and scratching because the tin-lead alloy is relatively soft. Hence, an improved electrical connector is required to overcome the disadvantages of the prior art.

SUMMARY OF THE INVENTION

An object of the present invention is to provide an improved method of making an electrical connector, the electrical connector having a conductive shield no only resistant to corrosion and scratching but also easily soldered to a printed circuit board.

To obtain the above object, a method of the present invention comprises the steps of:

a. Forming an insulative housing;

b. Making a contact module;

c. Stamping and forming a conductive shield having a body portion and a pair of integral solder tails on the body portion;

d. Applying a plating of nickel material on both the body portion and the integral solder tails of the conductive shield;

e. Applying a plating of tin-lead alloy material on only the integral solder tails by selective plating; and f. Assembling the contact module, the insulative housing and the conductive shield together.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
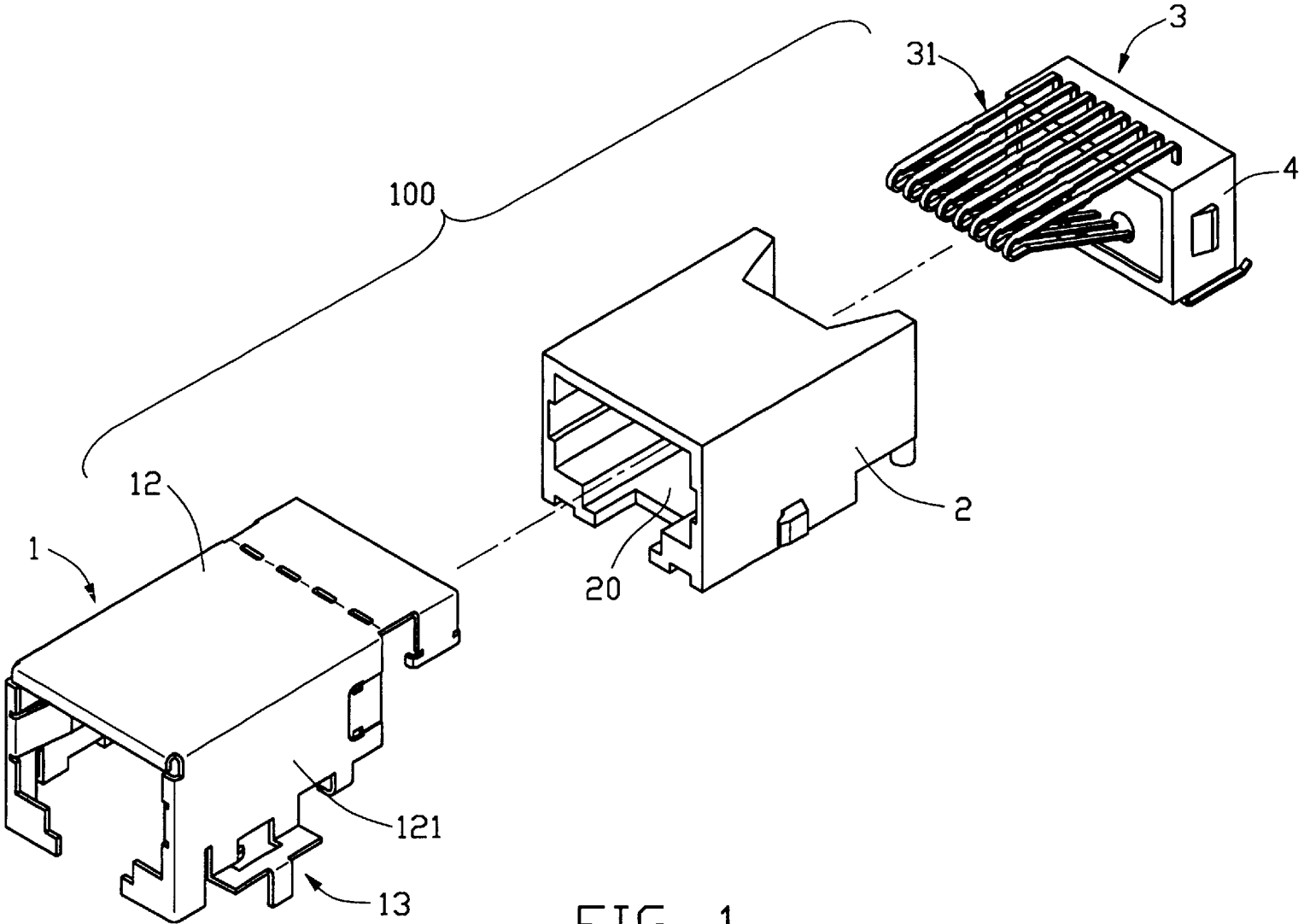
FIG. 1 is an exploded perspective view of an electrical connector in accordance with the present invention, wherein a rear plan sheet is open.

Referring to FIG. 1, an electrical connector 100 in accordance with the present invention comprises a conductive shield 1, an insulative housing 2 enclosed in the shield 1 and a contact module 3 engageably inserted in the housing 2. The contact module 3 includes a dielectric insert 4 and a plurality of contacts 31 insert-molded in the insert 4 in a row.

Figure 2:
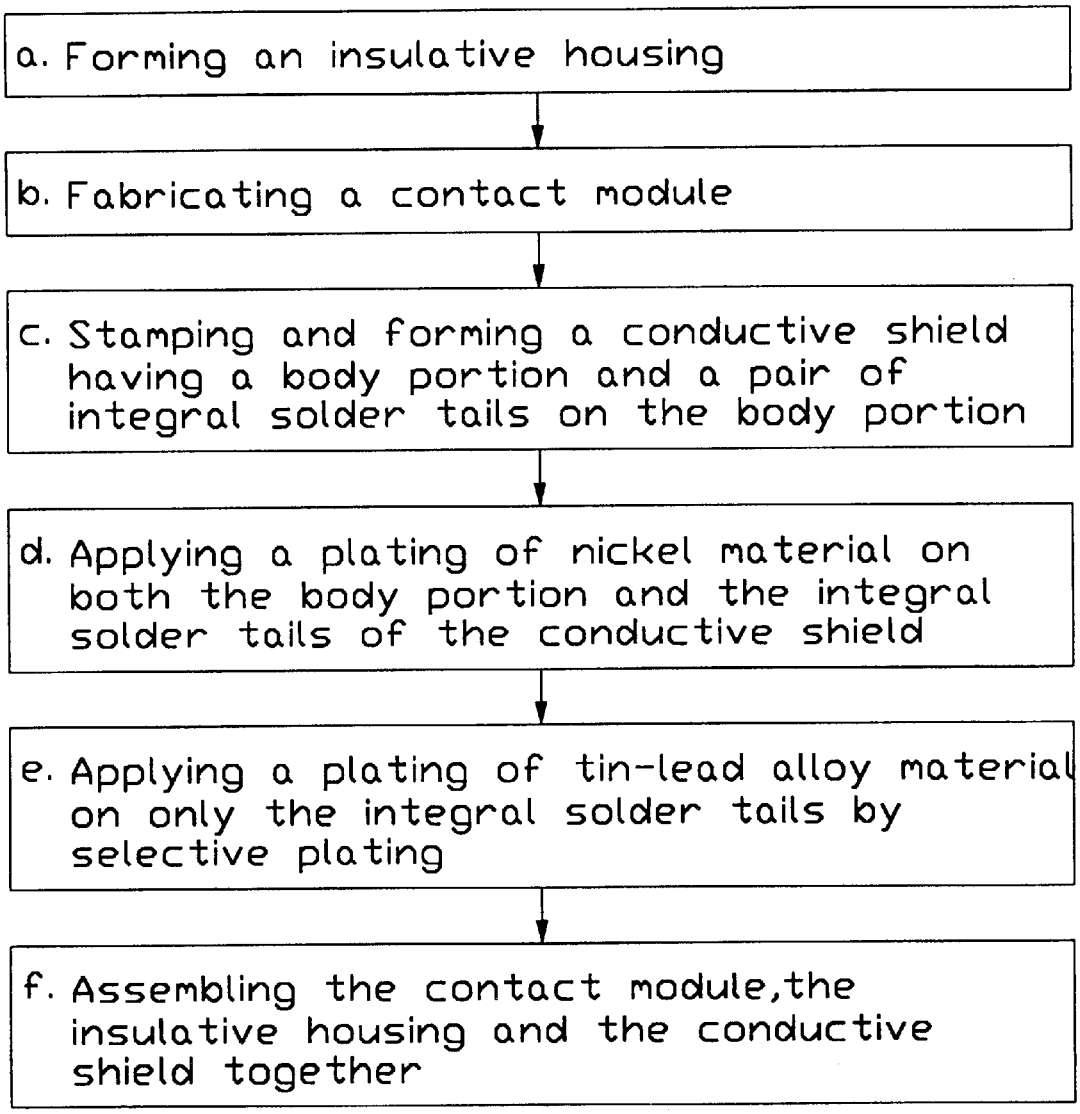
FIG. 2 is a flow chart showing steps for making the electrical connector of FIG. 1.
Figure 3:
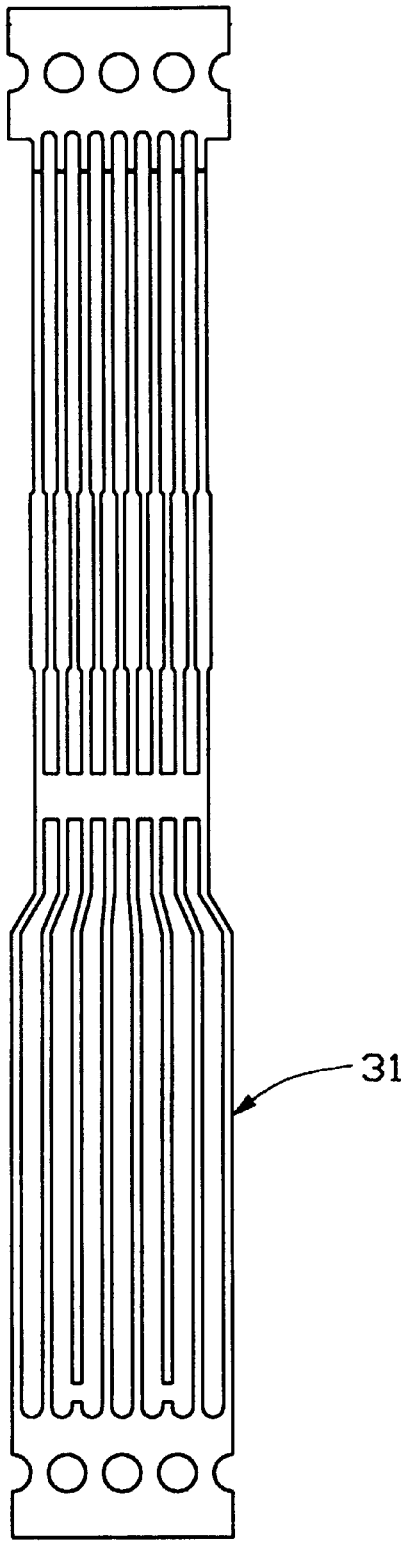
FIG. 3 is a plan view of a stamped contact strip of the electrical connector of FIG. 1.
Figure 4:
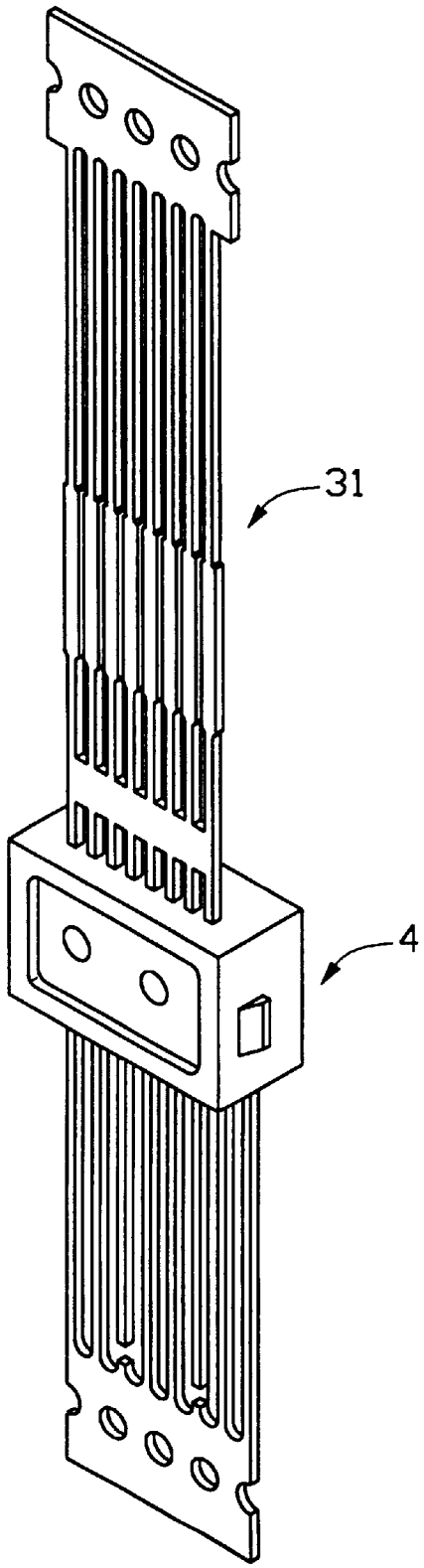
FIG. 4 is a perspective view of the contact strip of FIG. 3 insert-molded to a dielectric insert to form an intermediate configuration of a contact module.
Figure 5:
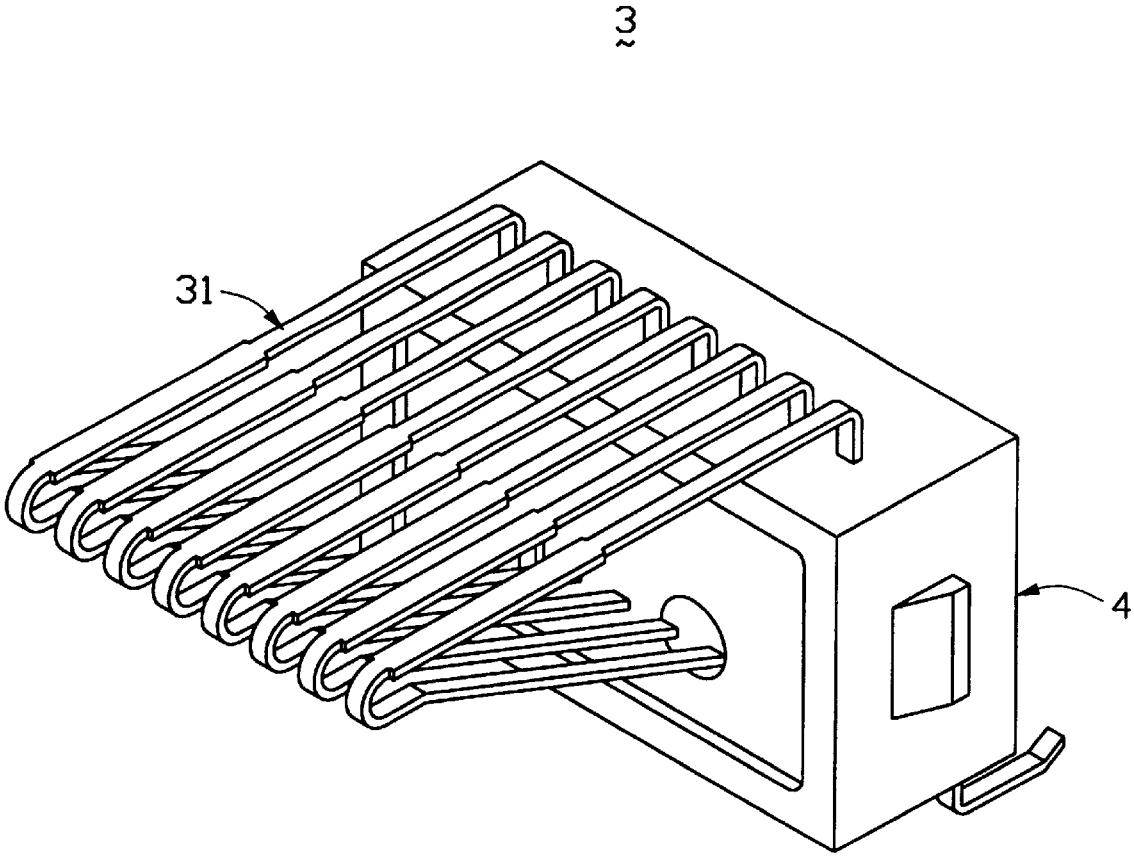
FIG. 5 is an enlarged perspective view of a final configuration of the contact module of FIG. 4.

Referring to FIG. 2 in conjunction with FIG. 1, the method of making the electrical connector 100 includes the steps of: a. Forming the housing 2 which defines a chamber 20 therethrough in a rear-to-front direction; b. Making the contact module 3; c. Stamping and forming the shield 1 having a body portion 12 and a pair of integral solder tails 13 on the body portion 12; d. Applying a plating of nickel material on both the body portion 12 and the integral solder tails 13 of the shield 1; e. Applying a plating of tin-lead alloy material on only the integral solder tails 13 by selective plating; f. Assembling the contact module 3, the housing 2 and the shield 1 together. The step a is well known in the art, so a detailed description of the step a is omitted herefrom for simplicity. FIGS. 3–5 illustrate sub-steps for step b, making the contact module 3. These sub-steps are similar to those disclosed in the U.S. Pat. No. 6,125,535, granted to the same assignee as the instant invention on Oct. 3, 2000, which is incorporated herein by reference.

Figure 6:
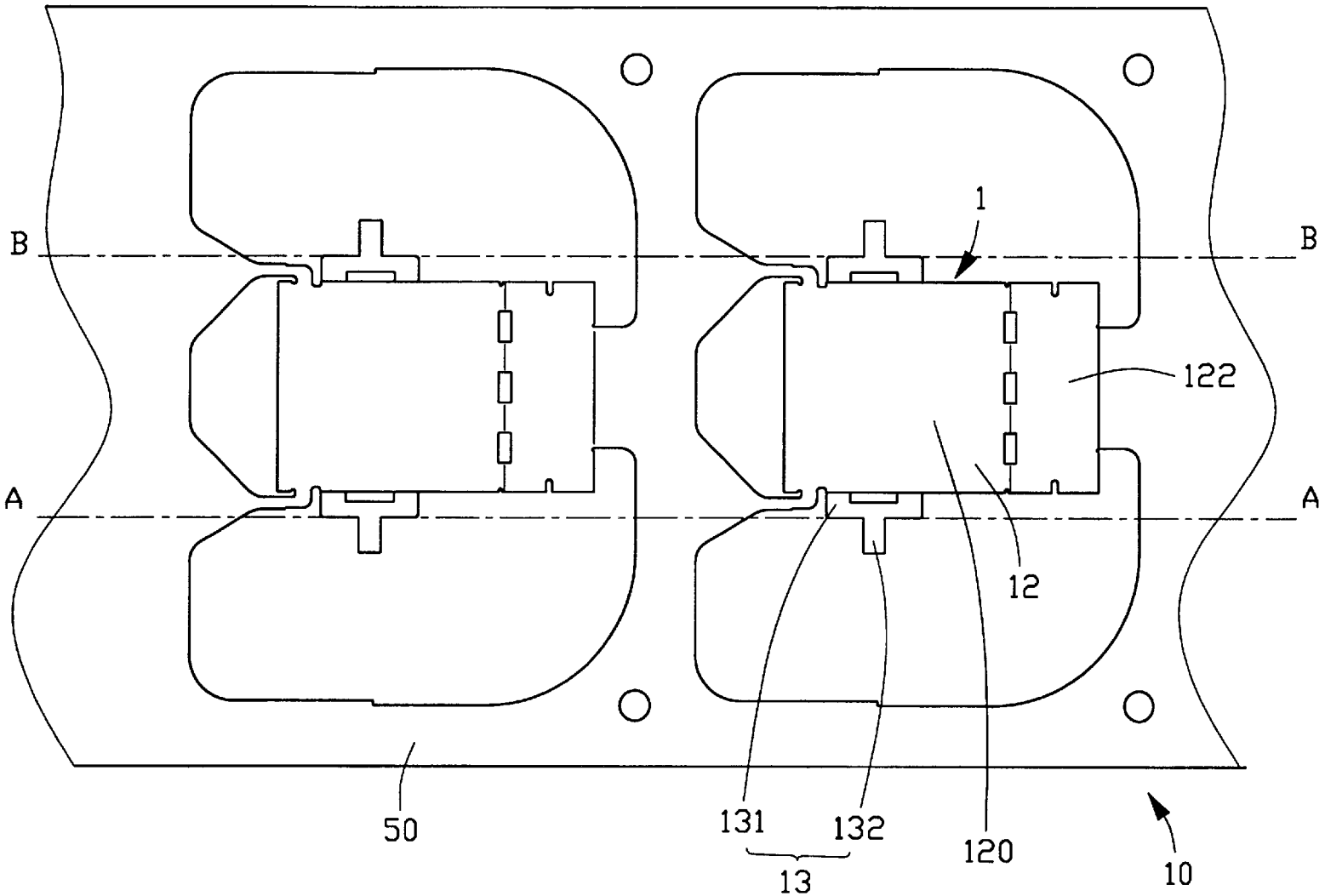
FIG. 6 is a top plan view of a stamped and formed shield strip.
Figure 7:
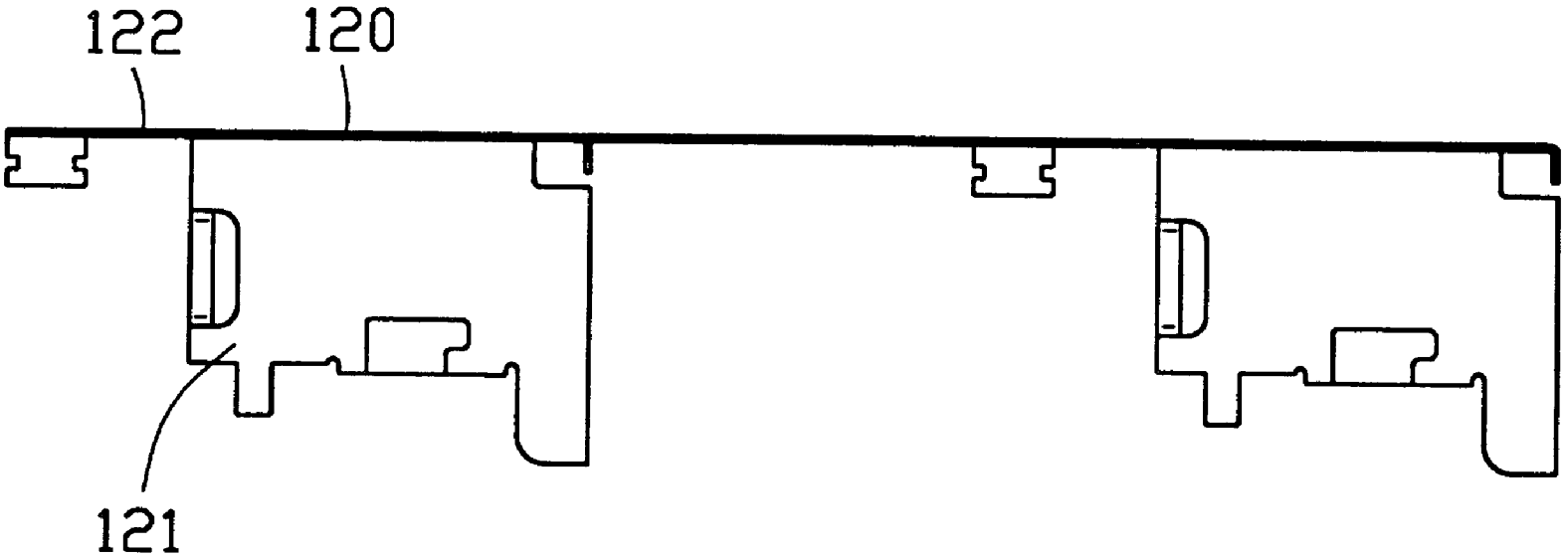
FIG. 7 is a side plan view of FIG. 6 taken from a left perspective.

Referring to FIGS. 6 & 7, in step c, a metal sheet is stamped and formed to become a shield strip 10 having a plurality of shields 1 and a carrier web 50 joining the shields 1 in a row. The stamping and forming process of the shield strip 10 is similar to that disclosed in U.S. Pat. No. 6,125,535, which is incorporated herein by reference. Each shield 1 has a body portion 12 having a top plan sheet 120, a pair of side plan sheets 121 downwardly extending from respective opposite side edges of the top plan sheet 120, and a rear plan sheet 122 rearwardly extending from a rear edge of the top plan sheet 120. Each shield 1 further has a pair of integral solder tails 13, including a shoulder 131 and a pin 132 outwardly extending from bottom edges of the respective side plan sheets 121 and generally perpendicular to the side plan sheets 121.

After stamping and forming, in step d, the shield strip 10 is completely immersed in a first plating cell filled with a first plating bath containing a solution of nickel, to apply a first layer of plating on both the body portions 12 and the solder tails 13. In step e, the shield strip 10 is first turned edgewise and an edge indicated by the line A—A of FIG. 6 is dipped into a second plating cell filled with a second plating bath, this one containing a tin-lead alloy solution, to selectively apply a second layer of plating on the pins 132 under the line A—A only. Subsequently, the shield strip 10 is turned 180 degrees and the edge above the line indicated by the line B—B of FIG. 6 is dipped edgewise into the second plating bath so that a second layer of plating is selectively applied on the pins 132 shown above line B—B of FIG. 6. After plating, the pins 132 are bent downwardly to be generally perpendicular to corresponding shoulders 131. Finally, the shields 1 are severed from the carrier web 50.

Figure 8:
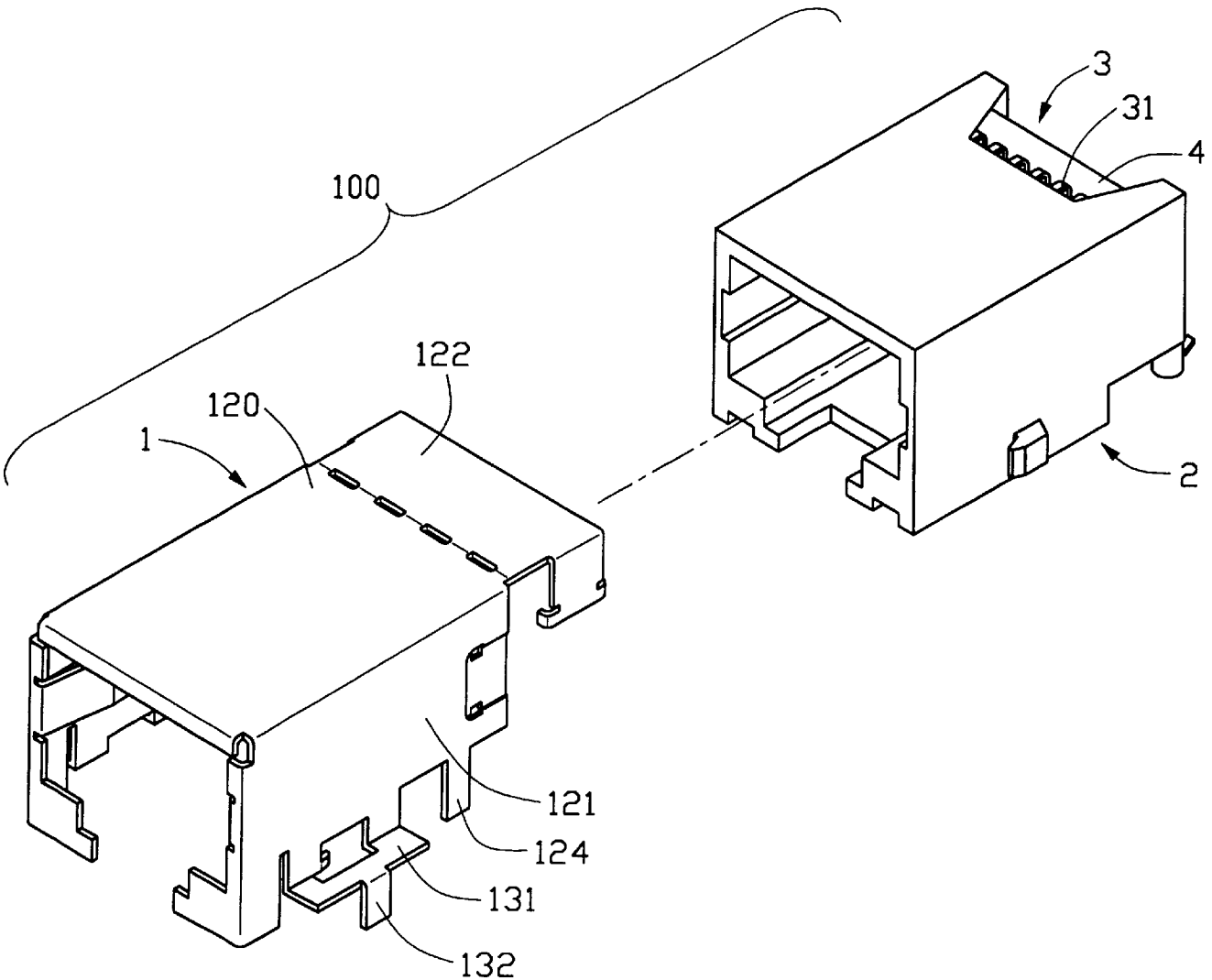
FIG. 8 is similar to FIG. 1 but showing the contact module securely assembled to an insulative housing.

Referring to FIG. 8 in conjunction with FIG. 1, in step f, the connector 100 is assembled. The contact module 3 is engageably inserted in the chamber 20 of the housing 2, and the shield 1 is assembled to and shrouds the housing 2 therein. The rear plan sheet 122 is downwardly bent to engage with the opposite side plan sheets 121, and tabs 124 at the bottom edges of the side plan sheets 121 are inwardly bent to engage with the housing 2.

Figure 9:
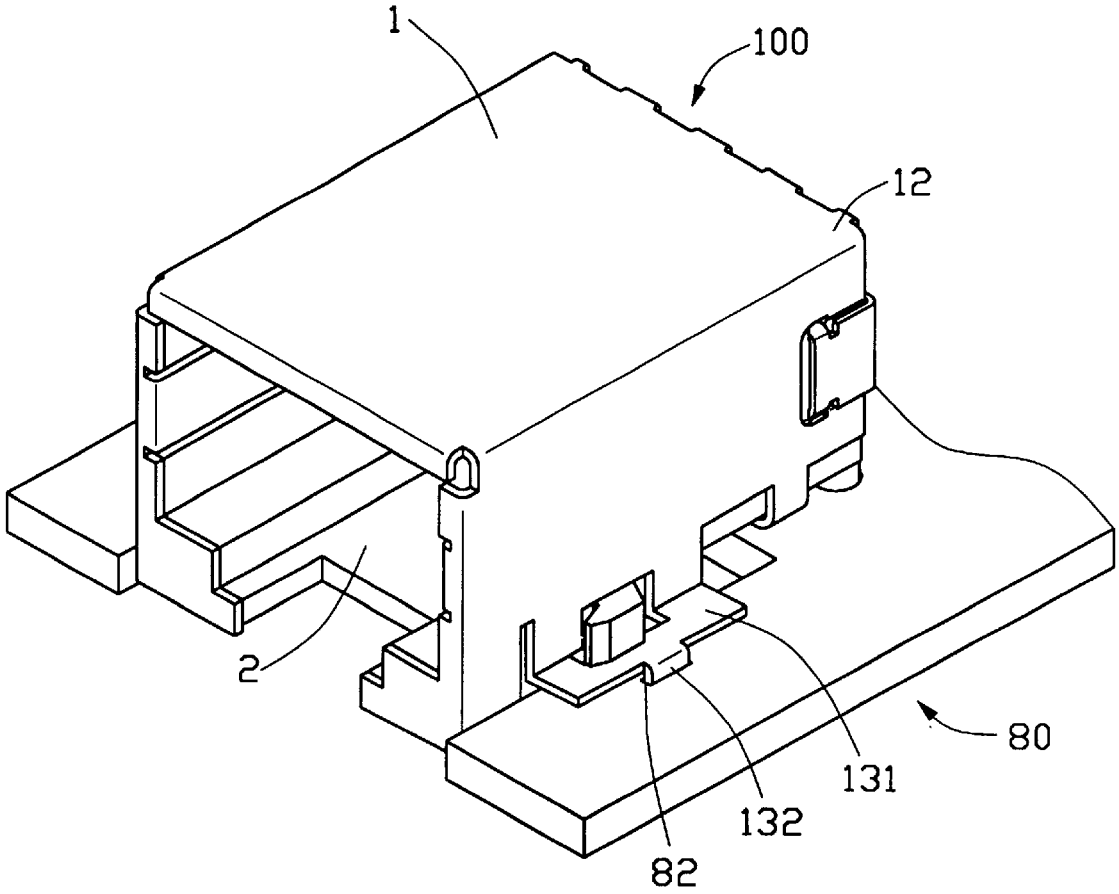
FIG. 9 is a perspective view of the completely assembled connector of the present invention mounted on a printed circuit board.

Referring to FIG. 9, the connector 100 is mounted to a printed circuit board (PCB) 80 with the shoulders 131 bearing against the PCB 80 to support the connector 100 and the pins 132 being inserted through corresponding through holes 82 defined in the PCB 80. When the connector 100 and the PCB 80 subsequently undergo a soldering process, tin-lead alloy soldering material adheres to both the tin-lead alloy plating on the pins 132 and to the printed pads in the through holes 82, thereby electrically and mechanically connecting the pins 132 with the printed soldering pads.

As disclosed above, the body portion 12 of the shield 1 has a plating of nickel, which has excellent anti-corrosion performance. Therefore, the connector 100 is durable. Furthermore, the plating of tin-lead alloy material improves the soldered connection of the pins 132 to the PCB 80. Therefore, the engagement of the pins 132 with the PCB 80 is more secure than it would be using the method of the prior art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method of making an electrical connector comprising the steps of:

forming an insulative housing;

making a contact module having a dielectric insert and a plurality of contacts retained in the insert;

stamping and forming a conductive shield having a body portion and two integral solder tail on the body portion;

applying a first plating on both the body portion and the integral solder tails of the conductive shield;

applying a second plating on the at least one integral solder tail only; and assembling the contact module, the insulative housing and the conductive shield together wherein the housing defines a chamber therethrough in rear-to-front thereof for engageably inserting the contact module in the chamber;

wherein the contacts are insert-molded in the insert;

wherein, during first and second plating, the integral solder tails each have a shoulder and a pin outwardly and perpendicularly extending from a corresponding side plan sheet of the body portion of the shield;

wherein, during application of the second plating, only the pins dip in a plating bath to apply the second plating thereon;

wherein, after the second plating, the solder tails are bent to be generally perpendicular to the shoulder;

wherein, during application of the second plating, the shield is turned edgewise and only the pin of a selected solder tail is dipped in a plating bath to apply the second plating thereon;

wherein, following application of the second plating to the pin of the selected one solder tail, the shield is rotated 180 degrees and is dipped edgewise a second time in the plating bath to apply the second plating to the other solder tail;

wherein, after the second plating, the pins of the solder tails are bent to be generally perpendicular to the corresponding shoulder.

* * * * *